US006892420B1

(12) United States Patent
Haan et al.

(10) Patent No.: US 6,892,420 B1
(45) Date of Patent: May 17, 2005

(54) VACUUM CLEANER WITH HAIR WRAP CUTTER

(75) Inventors: David L. Haan, Wyoming, MI (US); Tom Minh Nguyen, Grand Rapids, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 348 days.

(21) Appl. No.: 10/064,740

(22) Filed: Aug. 12, 2002

Related U.S. Application Data

(60) Provisional application No. 60/311,893, filed on Aug. 13, 2001.

(51) Int. Cl.[7] ..... A47L 9/04
(52) U.S. Cl. ..... 15/339; 15/383; 15/391
(58) Field of Search ..... 15/339, 383, 389, 15/391

(56) References Cited

U.S. PATENT DOCUMENTS

| | | | | |
|---|---|---|---|---|
| 936,887 A | | 10/1909 | Healey | |
| 2,560,307 A | | 7/1951 | Slemmons | |
| 2,671,923 A | | 3/1954 | La Briere | |
| 2,733,000 A | * | 1/1956 | Sparklin | 15/339 |
| 4,445,878 A | | 5/1984 | Linke et al. | |
| 5,623,745 A | * | 4/1997 | Stanek | 15/339 |
| 6,170,119 B1 | | 1/2001 | Conrad et al. | 15/339 |

* cited by examiner

*Primary Examiner*—Theresa T. Snider
(74) *Attorney, Agent, or Firm*—McGarry Bair PC

(57) ABSTRACT

A vacuum cleaner that has a rotary floor agitator driven by a motor has a hair cutter blade mounted adjacent a motor shaft that drives the agitator and/or at the ends of the agitator. The agitator is driven by an electric motor through a drive belt. The cutter blade(s) are designed to sever elongate particles, such as hair or threads that would build up on the agitation brush, drive belt and motor output shaft to hinder the operation of the brush and belt or otherwise dislodged the belt from the motor shaft.

18 Claims, 3 Drawing Sheets

VACUUM CLEANER WITH HAIR WRAP CUTTER

CROSS REFERENCE TO RELATED APPLICATIONS

This application claims the benefit of U.S. provisional patent application Ser. No. 60/311,893, filed Aug. 13, 2001, entitled VACUUM CLEANER WITH HAIR-WRAP CUTTER.

BACKGROUND OF INVENTION

1. Field of the Invention

The invention relates to vacuum cleaners and, more particularly, to vacuum cleaners having an agitation brush. In one of its aspects, the invention relates to a vacuum cleaner having cutters positioned adjacent the brush and any brush drive belt to prevent build-up of elongate particles, such as hair and thread, that will interfere with operation of the brush and belt.

2. Description of the Related Art

Vacuum cleaners with a rotational agitation brush are known. Typically, brush drive is accomplished by a drive belt linking an electric drive motor to the agitation brush. A common problem known in the rotational driving of an agitation brush is the accumulation of elongate particles such as hair, thread and carpet fibers about the rotational axis of the agitation brush and about the linkage mechanism connecting the drive belt to the electric motor and the agitation brush. Prior attempts have been made to inhibit and reduce the accumulation of debris around the brush and linkage mechanism are also known. One such device is disclosed in U.S. Pat. No. 2,671,923 issued to La Briere on Mar. 16, 1954. In La Briere, a suction cleaner thread guard is mounted adjacent a shaft, the shaft driving a suction fan of the cleaner and a belt for driving an agitation brush. The thread guard is planar and aligned adjacent to the shaft to encourage axial air flow into the fan, and positioned proximate the shaft to prevent threads from wrapping around shaft as the suction air flows axially into the fan.

U.S. Pat. No. 6,170,119 issued to Conrad et al. on Jan. 9, 2001, discloses a method and apparatus for reducing the size of elongate particulate matter in a vacuum cleaner head. A cutting member installed in a fixed position in the main turbine housing cooperates with the blades of the main turbine to reduce the size of particulate matter as it travels through the housing.

U.S. Pat. No. 4,445,878 to Linke et al. on May 1, 1984 discloses a chain stripper device for mining machines incorporating an arcuate blade that extends into a groove of the chain wheel in order to separate the chain from the wheel as the wheel rotates.

U.S. Pat. No. 936,887 issued to Healey on Oct. 12, 1909 discloses a belt cleaner comprising a section of belting held in a bracket so that it presses against a working surface of an operating belt to clean dirt and other foreign matter from the belt.

U.S. Pat. No. 2,560,307 issued to Slemmons on Jul. 10, 1951 discloses a band and pulley structure including a scraper element for removing foreign material from the groove of a pulley such as used in a track-type vehicle.

SUMMARY OF INVENTION

According to the invention, a vacuum cleaner that comprises a housing defining an agitation cavity and a suction nozzle, a suction source in fluid communication with the suction nozzle, an agitation brush mounted in the agitation cavity for rotation about a brush axis, and an agitation brush drive connected to the agitation brush for rotating the agitation brush about the brush axis has at least one cutting blade positioned adjacent a portion of the agitation brush drive to prevent buildup of elongate particles on the portion of the agitation brush drive.

In one embodiment, the agitation brush drive comprises an electric motor with an output shaft connected to the agitation brush and the cutting blade is mounted adjacent to the motor output shaft. Preferably, the motor output shaft includes a spindle and the cutting blade is mounted adjacent to the spindle. The agitation brush drive further comprises a belt between the spindle and the agitation brush.

In a preferred embodiment of the invention, at least one additional cutting blade is mounted to the housing adjacent the agitator brush. Preferably, additional cutting blades are mounted to the housing adjacent to each end of the agitator brush.

The vacuum cleaner according to the invention can take a variety of forms. It can be an upright vacuum cleaner, a canister vacuum cleaner, a portable hand-held vacuum cleaner or a deep cleaner.

In another embodiment of the invention, a vacuum cleaner that comprises a housing defining an agitation cavity and a suction nozzle, a suction source in fluid communication with the suction nozzle, an agitation brush mounted in the agitation cavity for rotation about a brush axis, and an agitation brush drive connected to the agitation brush for rotating the agitation brush about the brush axis has at least one cutting blade mounted to the housing adjacent a portion of the agitator brush to prevent buildup of elongated particles on the portion of the agitation brush.

Preferably, the portion of the agitator brush is adjacent an end of the agitator brush. In a more preferred embodiment of the invention, a cutting blade mounted to the housing adjacent to each end of the agitator brush.

The invention reduces the accumulation of elongate particles in the brush bearings and the motor drive, thereby reducing the interference of these particles with the proper operation of the agitation brush.

DETAILED DESCRIPTION

A vacuum cleaner with hair-wrap cutter is herein disclosed by way of example with reference to the drawings, FIGS. 1–4. Any portion of the vacuum cleaner not specifically described herein is disclosed in U.S. Pat. No. 6,256,833, which is incorporated herein by reference in its entirety. The hair-wrap cutter according to the invention is shown and described in the context of an upright vacuum cleaner, but the hair-wrap cutter according to the invention is similarly applicable in other forms of vacuum cleaners having a rotational agitator, such as attachments for upright or canister vacuums and hand-held vacuum cleaners. The hair-wrap cutter according to the invention is further applicable to a deep cleaning machine having a rotational agitator such as disclosed in commonly owned U.S. Pat. No. 6,167,587, which is incorporated by reference in its entirety.

Figure 1:
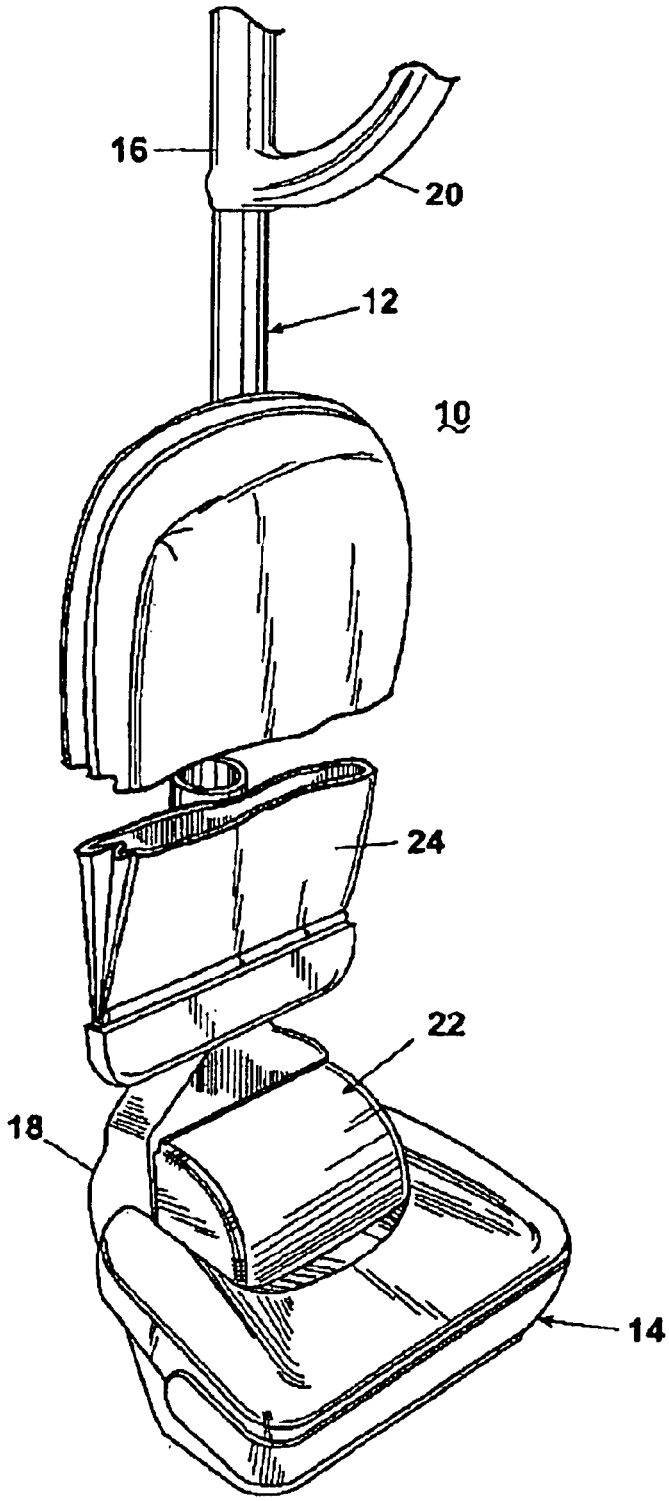
FIG. 1 is a partial perspective view of an upright vacuum cleaner according to the invention with the handle assembly in the upright or storage position.
Figure 2:
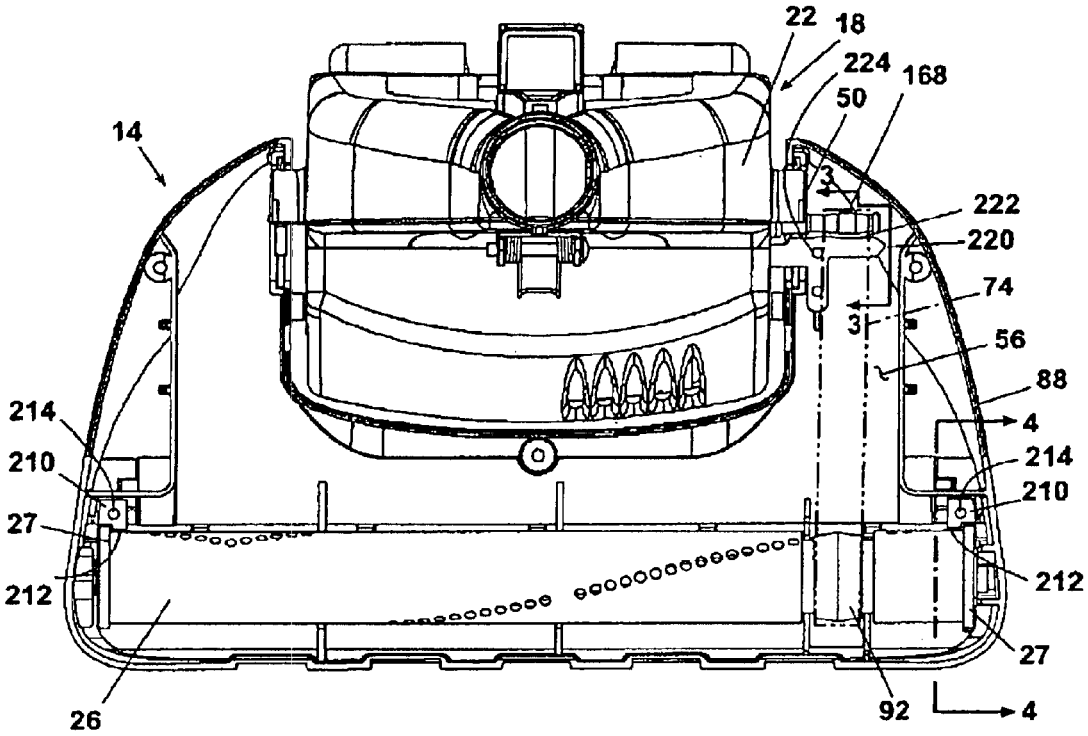
FIG. 2 is a cutaway plan view of the base module of the upright vacuum cleaner of FIG. 1.

With reference to FIGS. 1 and 2, an upright vacuum cleaner 10 is illustrated and includes a handle assembly 12 pivotally connected to a base module 14. More specifically, the handle assembly 12 includes an upper end 16 including a hand grip 20 and a lower end 18 including an arcuate motor and lamp housing 22. Between the upper end 16 and lower end 18 is mounted a soft collection bag 24. The base module 14 includes a front end housing an agitation brush 26 and a rear end including a pivotal connection to the arcuate motor and lamp housing 22 of the handle assembly 12. The bag 24 is porous and exhausts air that flows to the bag 24. Housed within the bag 24 is a filter bag (not shown) that captures dirt and debris from the air that enters the filter bag in conventional fashion. The invention also contemplates a hard impervious bag housing and a filter bag mounted within the hard impervious bag housing for a clean air system as, for example, disclosed in the Jailor U.S. Pat. No. 5,544,385 which is incorporated herein by reference. In the clean air system, the dirty air is drawn through the filter bag by a suction motor.

Figure 3:
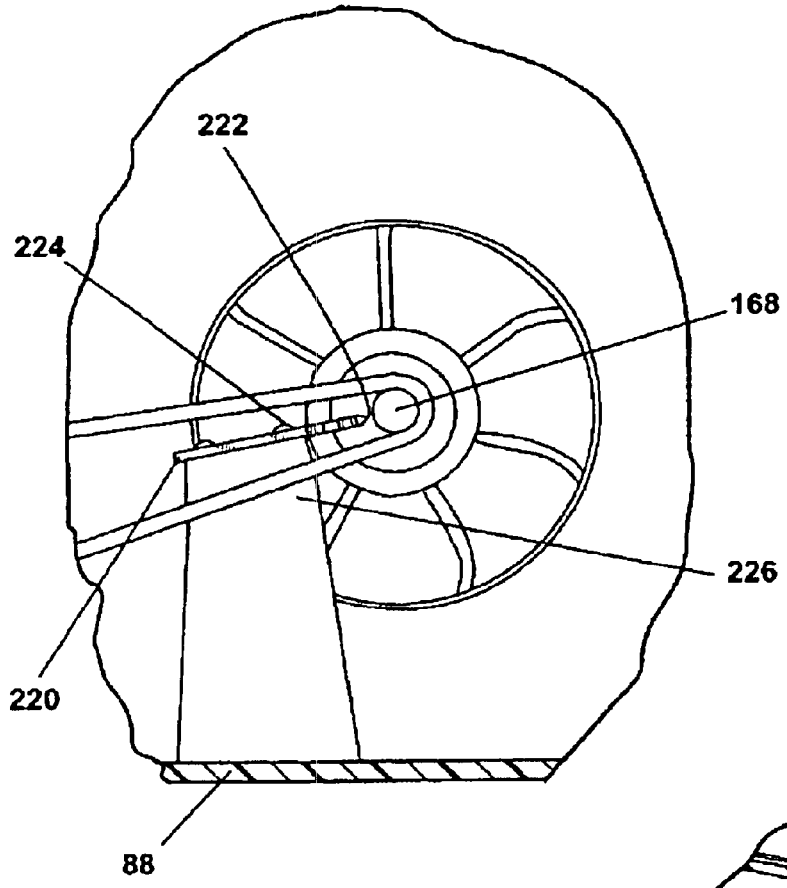
FIG. 3 is a partial cross-sectional view taken through line 3—3 of FIG. 2.
Figure 4:
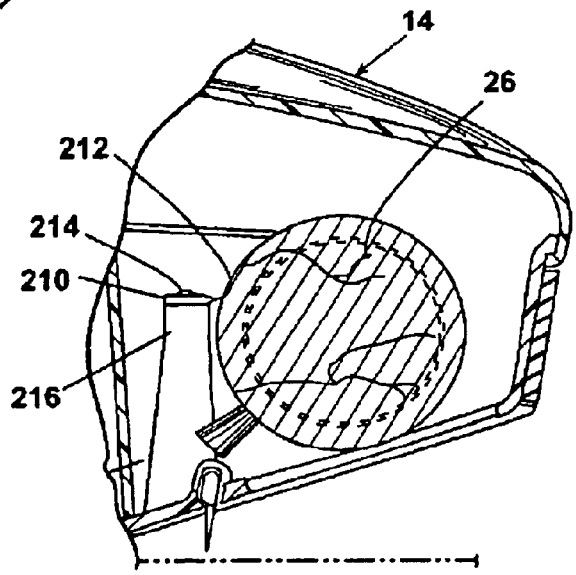
FIG. 4 is a partial cross-sectional view taken through line 4—4 of FIG. 2.

Referring now to FIGS. 2–4, the agitator brush includes a spindle that is rotatably mounted to the outer housing of the base module 14 at each end thereof in conventional fashion. The spindle has one or more rows of bristles that agitate a carpet to be cleaned. A hair-wrap cutter 210 is mounted in the base module 14 housing adjacent each end 27 of brush 26 and adjacent to the rotational mountings. The cutters 210 are positioned closely adjacent the surface of brush spindle and parallel to the axis of rotation of the brush 26 to minimize the buildup of elongate particles such as hair, thread or carpet fibers on the brush 26 and especially adjacent the brush ends 27 where such elongate particles may interfere with the rotational mounting of the brush 26 in the base module 14 housing. Hair wrap cutters 210 include a cutting edge 212 adjacent the spindle of the brush 26 to sever and break up the elongate particles. Each hair-wrap cutter 210 is mounted to the base module 14 by a fastener 214 such as a screw received in an integrally molded boss 216 of the base module 14 housing.

A third hair-wrap cutter 220 is mounted to the bottom shell 88 of base module 14 in like fashion, with a pair of fasteners 224 mounting the cutter 220 to an integrally molded boss 226. Housing 22 houses a drive motor (not shown) having a motor shaft extending from housing 22 and mounting a spindle 168 for mounting and driving a drive belt 74 (shown in phantom in FIG. 2). Cutter 220 includes a cutting edge 222 positioned adjacent to spindle 168. Belt 74 is further received in groove 92 of rotating brush 26. Hair wrap cutter 220 is mounted closely adjacent spindle 168 and between the two portions of belt 74 extending from spindle 168 toward brush 26 to avoid interference with the operation of belt 74 on spindle 168. Elongate particles carried through secondary air passageway 56 adjacent belt 74 are prevented from building up on spindle 168. Elongate particles picked up by the brush 26 also tend to be carried by the belt 74 to the spindle 168. Such elongate particles have a tendency to interfere with or dislodge belt 74 from spindle 168. Cutting edge 222 of cutter 220 cuts the elongate particles from the spindle 168 and prevents buildup to reduce such interference by elongate particles with the operation of the belt 74.

While particular embodiments of the invention have been shown, it will be understood that the invention is not limited thereto. For example, the invention can applied to any vacuum cleaner that has a rotatably driven agitator, including a canister vacuum, a hand held vacuum cleaner or an upright vacuum cleaner. The invention can also be used on deep cleaners or extractors of all types wherein a motor driven rotational agitator is employed. The invention can also be used on all types of agitators in addition to brushes. The invention can further be used with air turbine driven agitators as well as electrical motor driven agitators. Reasonable variation and modifications are possible without departing form the scope of the forgoing disclosure and drawings, particularly in light of the foregoing teachings, without departing from the spirit of the invention which is defined in the appended claims.

What is claimed is:

1. A vacuum cleaner comprising;

a housing defining an agitation cavity and a suction nozzle;

a suction source in fluid communication with the suction nozzle;

an agitation brush mounted in the agitation cavity for rotation about a brush axis;

an agitation brush drive connected to the agitation brush for rotating the agitation brush about the brush axis;

the improvement comprising, at least one cutting blade positioned adjacent a portion of the agitation brush drive to prevent buildup of elongate particles on the portion of the agitation brush drive.

2. The vacuum cleaner according to claim 1 wherein the agitation brush drive comprises an electric motor with an output shaft connected to the agitation brush and the cutting blade is mounted adjacent to the motor output shaft.

3. The vacuum cleaner according to claim 2 wherein the motor output shaft includes a spindle and the cutting blade is mounted adjacent to the spindle.

4. The vacuum cleaner according to claim 3 wherein the agitation brush drive further comprises a belt between the spindle and the agitation brush.

5. The vacuum cleaner according to claim 2 wherein the agitation brush drive further comprises a belt between the motor drive shaft and the agitation brush.

6. The vacuum cleaner according to claim 5 and further comprising at least one additional cutting blade mounted to the housing adjacent the agitator brush.

7. The vacuum cleaner according to claim 5 wherein the at least two cutting blades comprises two cutting blades, one mounted to the housing adjacent to each end of the agitator brush.

8. The vacuum cleaner according to claim 1 and further comprising a handle assembly pivotally attached to the housing.

9. The vacuum cleaner according to claim 1 and further comprising a canister mounting the suction source, and a flexible hose fluidly connecting the suction source to the suction nozzle.

10. The vacuum cleaner according to claim 1 wherein the housing mounts the suction nozzle, the suction source, the agitation brush, the agitation brush drive, and the at least one cutting blade.

11. The vacuum cleaner according to claim 1 and further comprising a handle assembly pivotally attached to the housing, wherein the suction nozzle, the suction source, the agitation brush, the agitation brush drive, and the at least one cutting blade are all mounted to the housing, and a liquid delivery and extraction system is mounted at least in part to the housing for discharging liquid onto and removing liquid from a surface to be cleaned.

12. A vacuum cleaner comprising;

a housing defining an agitation cavity and a suction nozzle;

a suction source in fluid communication with the suction nozzle;

an agitation brush mounted in the agitation cavity for rotation about a brush axis;

an agitation brush drive connected to the agitation brush for rotating the agitation brush about the brush axis;

the improvement comprising, at least one cutting blade mounted to the housing adjacent a portion of the agitator brush to prevent buildup of elongated particles on the portion of the agitation brush.

13. The vacuum cleaner according to claim 12 wherein the portion of the agitator brush is adjacent an end of the agitator brush.

14. The vacuum cleaner according to claim 13 and further comprising at least one additional cutting blade wherein the at least two cutting blades are mounted to the housing adjacent to each end of the agitator brush.

15. The vacuum cleaner according to claim 12 and further comprising a handle assembly pivotally attached to the housing.

16. The vacuum cleaner according to claim 12 and further comprising a canister mounting the suction source, and a flexible hose fluidly connecting the suction source to the suction nozzle.

17. The vacuum cleaner according to claim 12 wherein the housing mounts the suction nozzle, the suction source, the agitation brush, the agitation brush drive, and the at least one cutting blade.

18. The vacuum cleaner according to claim 12 and further comprising a handle assembly pivotally attached to the housing, wherein the suction nozzle, the suction source, the agitation brush, the agitation brush drive, and the at least one cutting blade are all mounted to the housing, and a liquid delivery and extraction system is mounted at least in part to the housing for discharging liquid onto and removing liquid from a surface to be cleaned.

* * * * *